United States Patent [19]

Cooke

[11] Patent Number: 4,706,837

[45] Date of Patent: Nov. 17, 1987

[54] TAMPER-RESISTANT PACKAGE

[75] Inventor: Carl W. Cooke, Sedalia, Colo.

[73] Assignee: Inventive Packaging Corporation, Castle Rock, Colo.

[21] Appl. No.: 842,902

[22] Filed: Mar. 24, 1986

[51] Int. Cl.[4] ..... B65D 39/04

[52] U.S. Cl. ..... 220/270; 215/232; 215/254; 215/355; 220/307

[58] Field of Search ..... 220/269, 270, 307, 359, 220/258; 215/232, 254, 255, 355; 222/541

[56] References Cited

U.S. PATENT DOCUMENTS

| | | | |
|---|---|---|---|
| 1,292,541 | 1/1919 | Townsend | 215/355 |
| 1,594,791 | 8/1926 | Miller | 222/541 |
| 1,758,916 | 5/1930 | Aulbach | 220/258 |
| 2,428,354 | 10/1947 | Blom | 220/258 |
| 3,084,835 | 4/1963 | Walsh | 222/541 |
| 3,089,609 | 5/1963 | D'Andrea | 220/270 |
| 3,273,737 | 9/1966 | Davis | 215/255 X |
| 3,473,705 | 10/1969 | May et al. | 222/541 |
| 4,418,831 | 12/1983 | Schellenberg | 220/258 |

FOREIGN PATENT DOCUMENTS

| | | | |
|---|---|---|---|
| 936244 | 2/1948 | France | 215/355 |

*Primary Examiner*—Donald F. Norton
*Attorney, Agent, or Firm*—Glenn K. Beaton

[57] ABSTRACT

A tamper resistant package consisting of a container and removable closure includes sealing means comprising an insert disposed in the interior of the container for sealing the container. The insert includes a tear-away section and a tab affixed to the insert at the tear-away section. The tab normally extends upwardly for removing the tear-away section when it is desired to open the container. If the tear-away section is partially or completely broken away from the body of the insert the user is provided with a positive, readily ascertainable indication that the package has been previously opened and possibly tampered with.

4 Claims, 6 Drawing Figures

TAMPER-RESISTANT PACKAGE

FIELD OF THE INVENTION

This invention relates to tamper-resistant packaging and more particularly to means for economically sealing packages so as to make them resistant to tampering.

BACKGROUND OF THE INVENTION

In recent years it has become a major concern of manufacturers of products designed for human consumption, such as pharmaceutical products, foodstuffs and the like, that the packages be resistant to tampering by individuals bent on the introduction of deleterious substances into the packages. For example, over the past several years there have been several examples of individuals who opened containers on the merchants shelf and introduced substances into the containers, i.e. cyanide and other poisonous substances which ultimately resulted in the death of persons who purchased and consumed the product without any warning that the product had been tampered with. In addition to the unfortunate deaths of the product users, such tampering, or the threat of tampering, has resulted in costly product recalls and loss of consumer confidence in the product and in the manufacturer of the product. As a result of these activities manufacturers and suppliers have been required to adopt relatively expensive measures to seal the product containers and packages in an attempt to protect the product against tampering. Such measures include the use of shrink fit materials over the outer packages as well as over the product containers themselves. Although such measures do provide some degree of protection against tampering, there is a substantial expense involved. For example, it has been estimated that for a bottle of non-prescription pain reliever the cost of attempting to protect against tampering run abougt $0.20–0.40 per bottle.

Accordingly it would be desirable to provide an economical means for sealing the containers of consumable products, which means would provide some protection against tampering and a positive indication that the product container has been opened thereby warning the user that the product may not be safe to use.

SUMMARY OF THE INVENTION

The present invention provides means for sealing a container which includes a sealing member disposed in the opening of the container and which normally seals the interior of the container until the product is ready to use. A portion of the sealing member is scored to define a tear-away section and an upstanding tab member is disposed on the tear-away section which when pulled will cause the tear-away section to part from the remainder of the sealing member to define an opening for the container. If the tear-away section is partly or completely broken away or removed from the sealing member, the user of the product will be aware that the container has been unsealed and possibly that the contents have been tampered with.

In a preferred embodiment of the invention, the sealing means comprises an insert adapted to be received within a container consisting of a sealing member, an upstanding annular skirt portion, preferably integrally formed with the sealing member, which is adapted to be received in the neck portion of the container and which acts to retain the sealing member in it's position in the container. Preferably, the inserted sealing member and the container are comprised of materials which are readily bonded together by automated methods such as ultrasonic welding and the like. In another embodiment of the invention, the sealing insert and the container may be provided with cooperating locking elements such as an annular rib and corresponding annular groove which provide a snap lock action for retaining the insert in it's position in the container.

DESCRIPTION OF THE INVENTION

Figure 1:
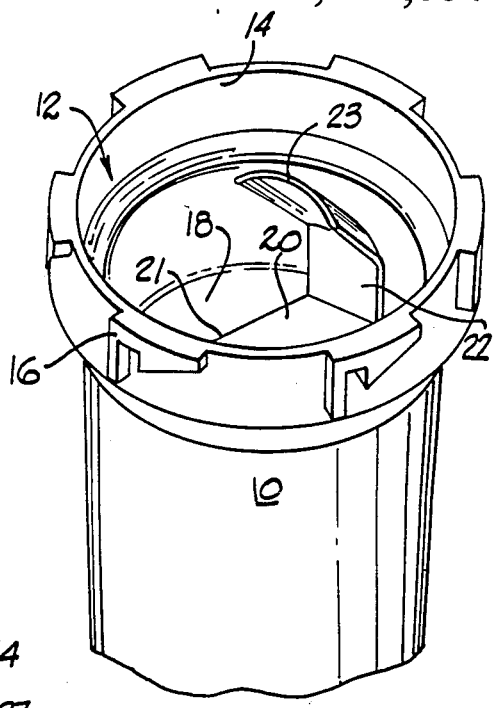
FIG. 1 is an isometric view of a container, partially broken away for compactness of illustration, with the sealing member of the present invention disposed in the container.

Referring to FIG. 1 there is illustrated a container 10 which is provided with tamper resistant sealing means, shown generally as 12, in accordance with the invention. The container 10 may be of any type commonly used for pharmaceutical products, food products and the like, such as a container having a defined constricted neck portion or as illustrated, a straight sided container having an opening 14, the circumference of which is substantially the same as the circumference of the interior of the container. The rim portion of the container 10 adjacent the opening 14 is provided with locking elements 16 which cooperate with correpsonding locking elements on a closure (not shown) for securing the closure on the container. Alternatively, the container 10 may be provided with threads which cooperate with matching threads on the closure to secure the closure on the container.

The sealing means 12 comprises a sealing member 18 which is disposed in the interior of the container normally adjacent the opening 14 which is retained by means which will be explained in more detail hereinafter and which seals the interior of the container 10. The relative axial position of the sealing member 18 with respect to the opening 14 of the container 10 is selected depending upon the nature of the contents of the container so that the sealing member 18 may also be used as a packing or securing means for the products within the container 10, in the same fashion as is served by cotton or other types of packing material. The sealing member 18 is provided with a tear-away section 20 which is defined by score line 21. An upstanding tab member 22 is secured on the tear-away section 20, preferably at one end thereof, and extends upwardly towards the opening 14 of the container. The upper end portion 23 of the tab member 22 may be disposed substantially perpendicularly to the tab member to aid in gripping the tab member when removing the tear-away section 20.

Figure 2:
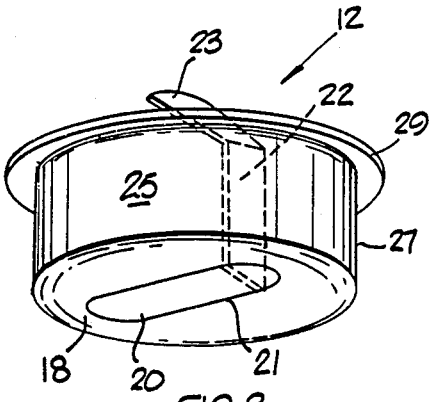
FIG. 2 is an isometric view illustrating one embodiment of the sealing member of the present invention prior to insertion in a container.
Figure 3:
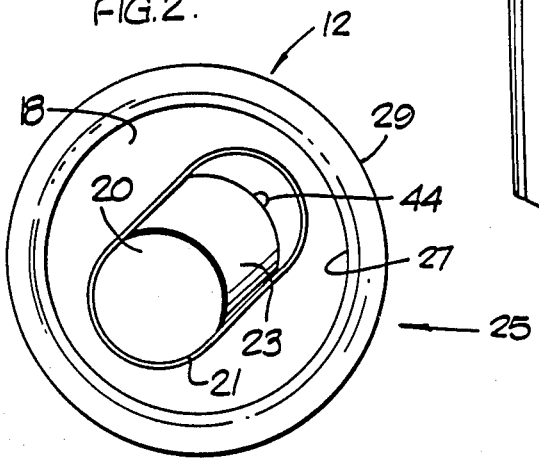
FIG. 3 is a plan view of the sealing member of FIG. 1.

For maufacturing economy the sealing means 12 is preferably formed separately from the container 10. As illustrated in FIG. 2 and FIG. 3, where like numbers designate like parts, the sealing means 10 is formed as an insert 25 consisting of the sealing member 18, which includes the tear-away section 20 defined by score line 21 and the tab member 22, and an upwardly extending skirt portion 27 which is preferably integrally formed with the sealing member 18. The insert 25 therefor defines a generally cylindrically shaped member which is closed at one end by the sealing member 18 and which is dimensioned so as to be received snugly in the opening 14 of the container 10. The open end of the insert 25 is provided with a lip 29 which is equivalent to or slightly larger than the rim of the container 109 so as to provide a stop for the insert 25 to accurately position the sealing member 18 within the container 10. The axial length of the skirt portion 27 is determined by the desired axial position of the sealing member 18 in the container.

In the preferred manufacturing practice, the insert 25 and the container 10 are constructed of the same or compatible materials which may be fused or bonded together. For example the insert 25 and the container 10 may both be formed of polypropylene or polyethylene copolymers which can be bonded together after the insert is positioned in the opening of the container by conventional means such as ultrasonic welding. In this fashion the insert is fused to and essentially becomes part of the container 10. In the alternative bonding materials, such as epoxy, may be utilized, particularly where the container is metal or glass so as to secure the insert 25 in the container 10. The use of separate bonding materials, however, does involve a separate operation which adds to the cost manufacture and it is highly preferred to use materials which can be readily bonded or fused by automated methods, such as ultrasonic welding. In the alternative, particularly where the composition of the insert and the container differ or are not readily fusible or bondable, mechanical locking means may be employed to retain the insert in the container.

Figure 4A:
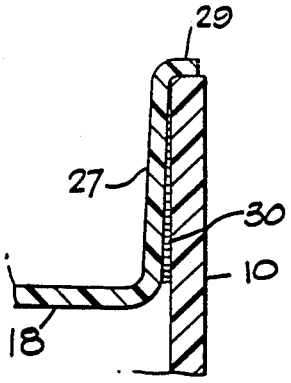
FIGS. 4*a*, 4*b*, and 4*c* are sectional views of a portion of the sealing member and container wall illustrating various methods for retaining the sealing member in position.
Figure 4B:
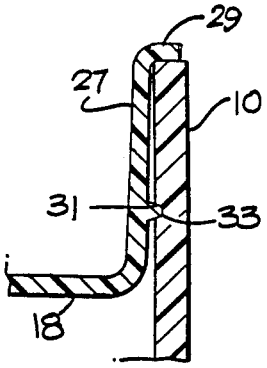
Figure 4C:
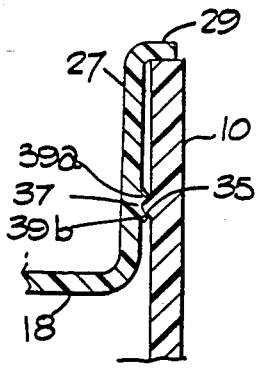

Referring to FIGS. 4*a*, 4*b* and 4*c*, there is illustrated several methods for retaining the insert 25 in the container 10. FIG. 4*a* illustrates a preferred embodiment wherein the outer surface of the skirt portion 27 is fused to the inner wall surface of the container 10. In this embodiment the composition of the insert and the composition of the container 10 are the same or are compatible materials which can be fused by ultrasonic welding. FIGS. 4*b* and 4*c* illustrate mechanical locking means for retaining the insert 25 in the container 10. Mechanical means are employed when the insert material and the container material do not lend themselves to bonding or fusing, such as for example where the container is made of glass or metal and the insert is made of metal or a polymeric material. As illustrated in FIG. 4*b* the skirt portion 27 of the insert 25 is provided with an annular ring 31 which is received in a corresponding groove 33 provided in the inner wall surface of the container 10. FIG. 4*c* illustrates yet another embodiment of mechanical locking means in which an annular rib 35 is disposed on the wall of the container 10 for being received in a corresponding groove 37 which is formed between a pair of spaced apart ribs 39*a* and 39*b* on the outer surface of the skirt portion 27 of the insert 25.

To unseal the container 10 with the sealing member 12 in place one simply pulls on the tab member 22 which by virtue of its attachment to the tear-away section 20 pulls the tear-away section away from the sealing member to define an opening for the container of same configuration as the tear-away section. As is most clearly shown in FIG. 3 the lower end of the tab member at the point of attachment to the tear-away member is broad and is provided with an extended portion 44 so that as the tab member is rocked about a fulcrum defined by its lower end the extended portion 44 acts as a lever to initiate tearing of the score line 21 at a point adjacent the extended portion of the tab. The configuration of the tear-away section 20 is largely dependent upon the nature of the product in the container 10. For example, assuming the contents of the container are pills or capsules, the opening of the container should be such as to permit only one, or at most, only a few tablets or capsules to be removed from the container at one time. This avoids the annoying problem of having the entire contents accidentally spill out when the user is attempting to extract a tablet or capsule.

While a preferred embodiment and modifications of the invention have been described in the foregoing description and illustrated in the drawings, it will be understood that minor changes may be in the details of construction as well as in the combination and arrangement of parts without departing from the spirit and scope of the invention as claimed.

I claim:

1. A tamper-resistant package consisting of a container having an interior and an opening; a removable closure and sealing means, said sealing means comprising a sealing member disposed in the interior of said container for sealing the opening, said sealing member including a tear-away section defined by a score line on said sealing member and a tab affixed to said sealing member at the tear-away section thereof, said sealing member normally sealing the interior of said container until said tear-away section is deliberately removed, thereby providing a positive indication that the package has been opened and providing communication between the interior of said container and the opening; an upwardly extending skirt portion integrally formed with said sealing member, said skirt portion being received in the opening of said container and cooperating with the inner walls of the container interior for carrying and retaining said sealing member therein; a pair of spaced annular ribs on the outer surface of the skirt portion of said sealing means which define therebetween an annular groove; and a corresponding cooperating annular rib on the inner surface of the interior of said container which is received in the annular groove of said sealing means, thereby to carry and retain said sealing means therein.

2. A tamper resistant sealing insert for a container comprising a cylindrically shaped body closed at one end to define a sealing member and open at the opposite end to define an upwardly extending skirt portion, which skirt portion is provided with a pair of spaced annular ribs which define therebetween an annular groove adapted to receive an annular rib disposed on the interior wall of said container for locking said insert into said container, said sealing member being scored to define a tear-away section thereof; and a tab member located on the tear-away section of said sealing member and extending toward the open end of said insert, whereby removal of said tear-away section provides a positive indication that the container in which said insert is placed has been opened.

3. A tamper resistant sealing insert for a container comprising a cylindrically shaped body closed at one end to define a sealing member and open at the opposite end to define an upwardly extending skirt portion, said sealing member being scored to define a tear-away section thereof; a tabbed member located on the tear-away section of said sealing member and extending toward the open end of said insert, whereby removal of said tear-away section provides a positive indication that the container in which said insert is placed has been opened; and means for translating a rocking motion on the top of said tabbed member to an axial force drawing said tear-away section apart from said sealing member.

4. The insert of claim 3, wherein said translating means includes a member extending from said tabbed member to said tear-away section toward the scored portion of said sealing member, so that a rocking force on said tab is translated to an axial force on said tear-away section.

* * * * *